United States Patent [19]

Kirilloff et al.

[11] Patent Number: 4,837,549

[45] Date of Patent: Jun. 6, 1989

[54] TAPPED RESISTOR GRID ASSEMBLY

[75] Inventors: Victor V. Kirilloff, Lincoln, Nebr.; William A. Benson, Pittsburgh, Pa.; Robert Cummins, Pittsburgh, Pa.; Richard S. Dawson, Pittsburgh, Pa.

[73] Assignee: Mosebach Manufacturing Company, Pittsburgh, Pa.

[21] Appl. No.: 158,858

[22] Filed: Feb. 22, 1988

[51] Int. Cl.[4] ..... H01C 3/00

[52] U.S. Cl. ..... 338/279; 338/280; 338/281; 219/539; 219/542

[58] Field of Search ..... 338/279, 280, 281, 282, 338/283, 288, 290, 293, 295; 219/542, 539, 552

[56] References Cited

U.S. PATENT DOCUMENTS

| | | | |
|---|---|---|---|
| 2,537,796 | 1/1951 | Sieklucki et al. | 201/63 |
| 2,680,178 | 6/1954 | Kuhn et al. | 201/69 |
| 3,237,142 | 2/1966 | Nuss | 338/280 |

*Primary Examiner*—C. L. Albritton
*Assistant Examiner*—M. M. Lateef
*Attorney, Agent, or Firm*—Buchanan Ingersoll

[57] ABSTRACT

In the assembly two or more strips of resistance material are positioned edge-to-edge and fan-folded between the side members of a frame. The strips are supported at their loops by insulated fixtures and each has a terminal at each end. The strips are embossed or indented between loops so as to form longitudinally extending offsets spaced from each other across the strip. The depth of those offsets is controlled so that the clear space between the adjoining flights is just sufficient to admit a flat metal strip inserted between them crosswise with a portion projecting to form a tap. That tap can be positioned anywhere between parallel flights of the resistor ribbon after the assembly of the unit. A channel-shaped clip fits over the projecting tap and the edges of the adjoining flights of resistor ribbon and is welded to the tap and the flights.

11 Claims, 4 Drawing Sheets

TAPPED RESISTOR GRID ASSEMBLY

This invention relates to resistor assemblies used for dynamic braking of electric motors. It is more particular concerned with such assemblies having a simplified but rugged structure and having one or more taps between their end terminals.

BACKGROUND OF THE INVENTION

The resistor assembly disclosed hereinbelow is primarily intended for diesel electric locomotives and similar vehicles. The heat generated in braking and the vibration of the moving vehicle are detrimental to the service life of resistor units in that service. Resistor units presently intended for that service are described in U.S. Pat. No. 2,680,178 issued to C. W. Kuhn et al. on June 1, 1954; U.S. Pat. No. 2,874,257, also to Kuhn et al. on Feb. 17, 1959 and U.S. Pat. No. 4,316,172 issued to William R. Luy on Feb. 16, 1982. The structure of those articles may be described as relatively narrow flat strips of resistor material reflexed or fan-folded in a frame containing two or more units arranged side by side. Such a structure facilitates the provision of taps for fan or otherwise at the junction of such units.

The electrical resistance of flat-strip resistor material is a function both of the dimensions of the strip, its chemical composition ad its processing. It would be desirable from the manufacturing standpoint to make resistor assemblies or grids from a small number of units of wide strip and, in fact, such a structure is disclosed in Harness U.S. Pat. Nos. 4,651,125 and 4,654,627 of Mar. 17 and Mar. 31, 1987, respectively. The Harkness grid members occupy the full width of the frame but they have no taps.

SUMMARY OF THE INVENTION

Our grid resistor assembly may be formed of resistor strip of any width up to the full width of its frame although we prefer to employ two half-width units. It is fan-folded between the side members of its frame and is supported at its reflexes or loops through suitable insulating fixtures. To increase the stiffness of the strip, we emboss or indent its flights or stretches so as to form longitudinally extending offsets spaced from each other across the strip. The depth of those offsets is controlled so that the clear space between adjoining flights is just sufficient to admit a flat metal strip inserted between them crosswise. A portion of the inserted strip is allowed to project, thereby forming a tap which tap can be positioned anywhere between the parallel flights of the resistor ribbon after the assembly of the unit. Our invention includes a channel-shaped clip which fits over the projecting end of the tap and over the edges of the adjoining flights and may be welded to the tap and those flights. Our invnetion also includes certain structural improvements which will be described.

DESCRIPTION OF PREFERRED EMBODIMENT

Figure 1:
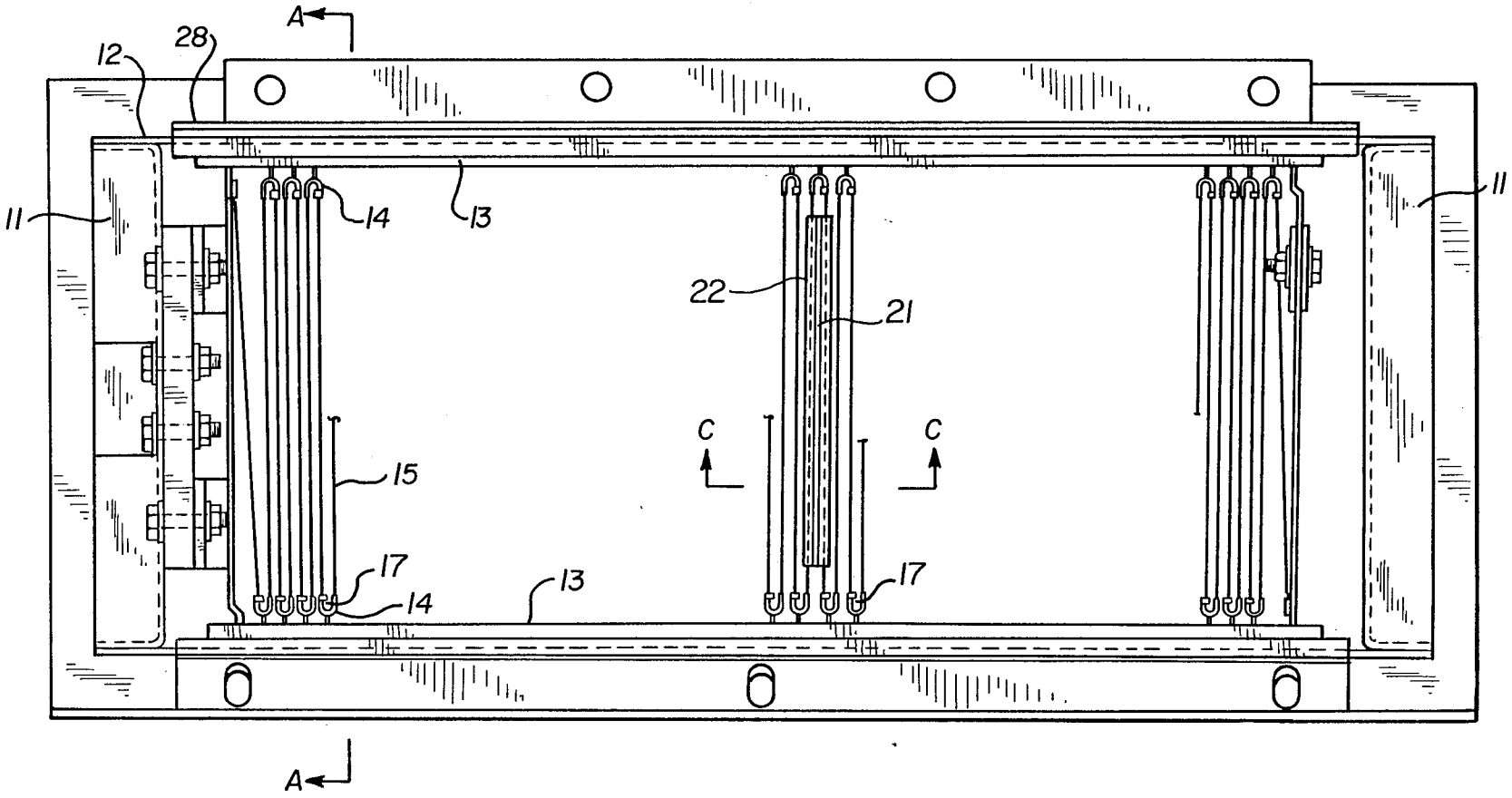
FIG. 1 is a side elevation of a resistor grid of our invention.

Our resistor is assembled in a box-shaped frame having metal end pieces 11 and metal side frames 12. Affixed to the side frames 12 are blocks of insulating material 13, preferably of molded copolymer. Those blocks carry clips 14 which hld the fan-folded ribbons 15 of resistance material at their loops or fold 16.

Figure 2:
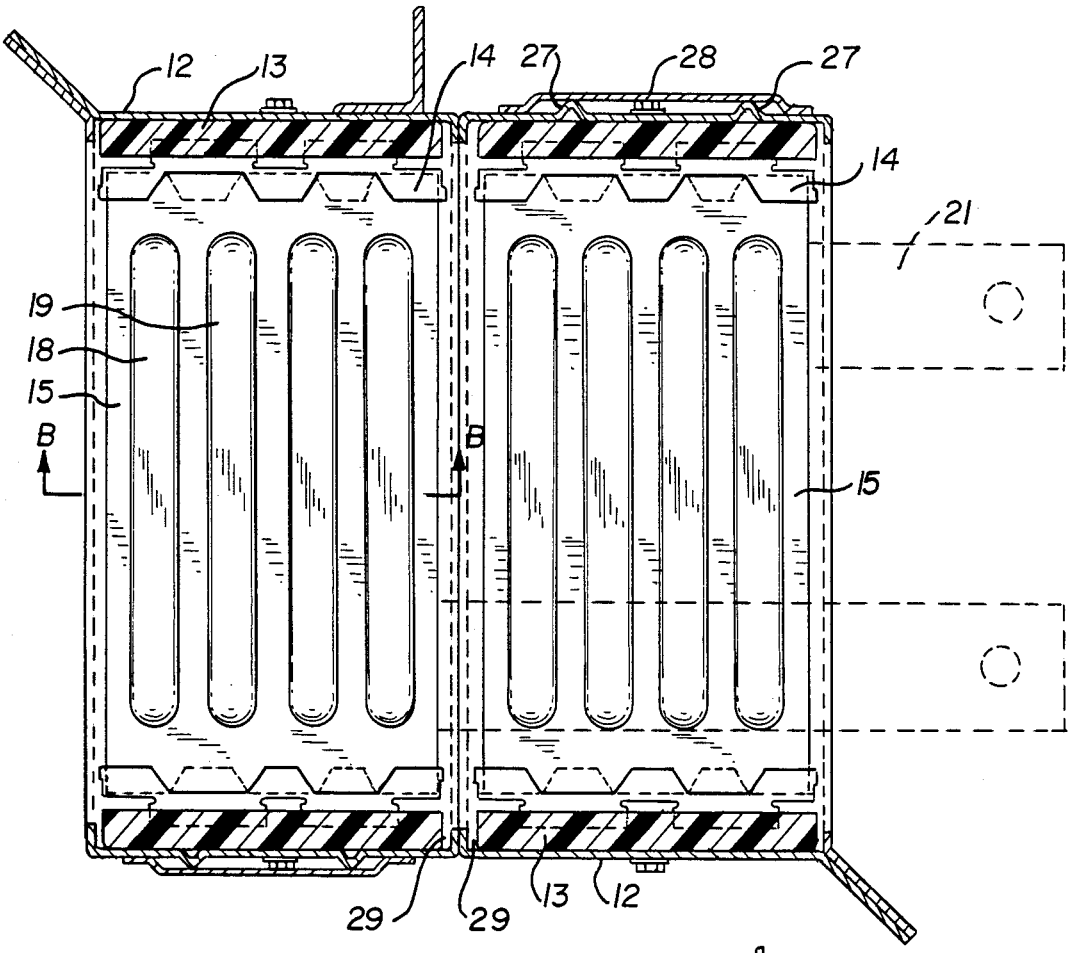
FIG. 2 is a vertical section taken on the plane AA of FIG. 1.
Figure 3:
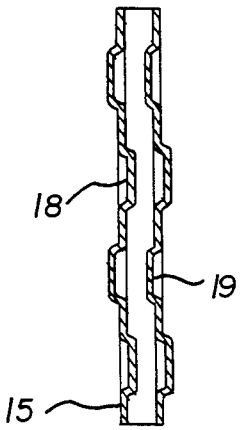
FIG. 3 is a partial cross section taken on the plane BB of FIG. 2.
Figure 4:
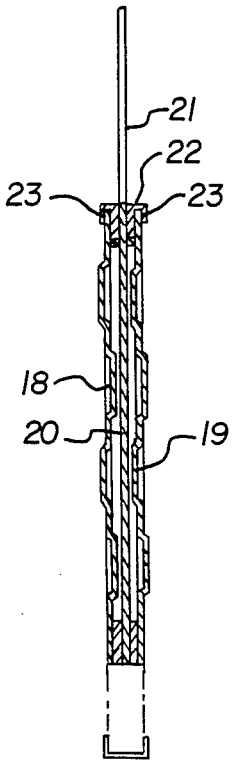
FIG. 4 is a cross section of the resistor ribbon taken on the plane CC of FIG. 1 showing a tap strip in place.
Figure 5:
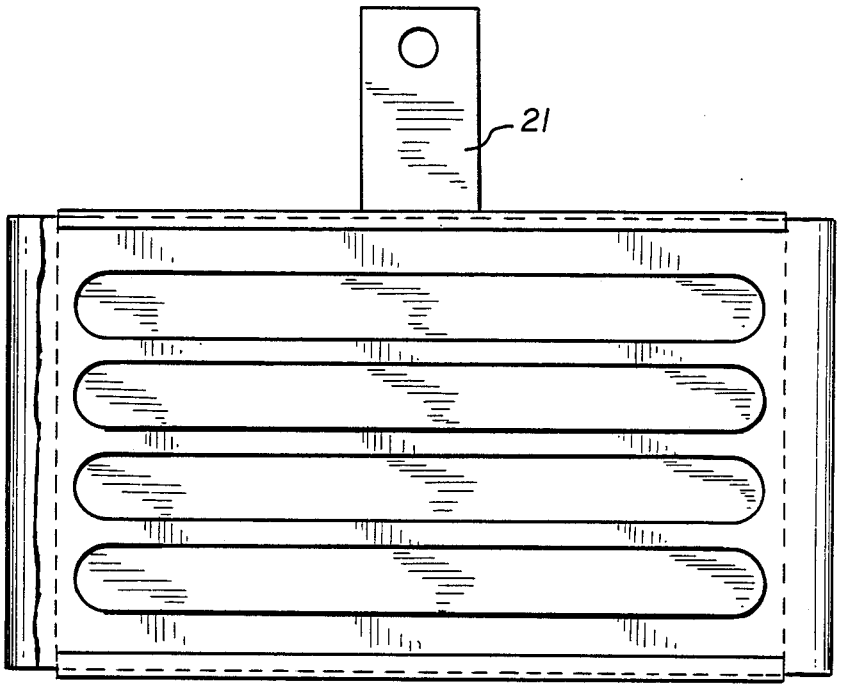
FIG. 5 is an elevation of the ribbon of FIG. 4.

The resistor element 15 is continuous and at each end is connected to a terminal 17, only one such terminal being illustrated in FIG. 1. We form our resistance element with longitudinal ribs or offsets 18 and 19 at each flight projecting on opposite sides of the ribbon as shown in FIGS. 2 and 3 in order to stiffen it. The spacing between indentations 18 of one flight and oppositely extending indentations 19 of the adjoining flight is controlled so that a flat rectangular strip of metal 20 fits closely between them as is shown in FIG. 4. Strip 20 extends beyond edges of resistor element 15 so as to form a tap 21 on the element 15, which tap may be inserted between any two adjoining flights of resistor element 15 after the resistor unit is assembled. Tap 21 may, of course, be removed from one location and inserted into another location between other adjoining flights of our assembled unit as may be desired without dismantling the resistor unit.

Figure 6:
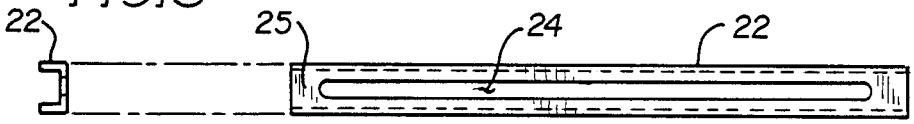
FIG. 6 is a plan of a weld cap.
Figure 7:
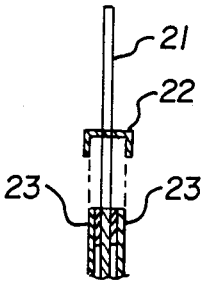
FIG. 7 is a detail of FIG. 4.

A tap which it is desired to fix in place may be so fixed by weld cap 22 shown in FIGS. 4, 6 and 7. weld cap 22 is a narrow channel of a length not greater than a length of a flight of resistor element 15 and a width between flanges 23 slightly greater than the spacing of resistor ribbon flights from each other. The web 25 of weld cap 22 is pierced by a longitudinal slot 24 of a length not less than the width of a tap 21 so that tap 21 projects through slot 24 when cap 22 is in place. Slot 24 is dimensioned to receive weld metal and tap 21, strip 20, adjoining flights of resistance element 15 and weld cap 22 are thereby all welded together.

Figure 9:
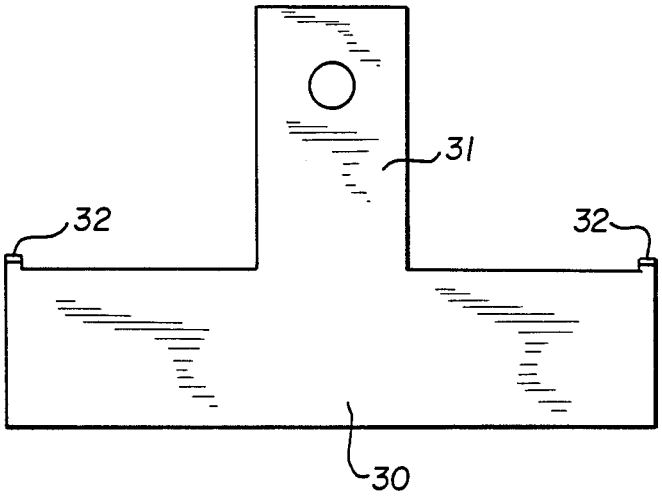
FIG. 9 is a plan of a modifified form of tap.
Figure 10:
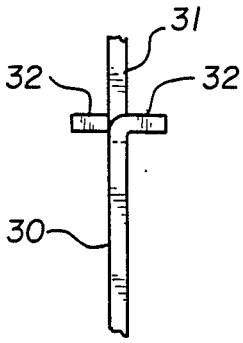
FIG. 10 is a partial end elevation of the tap of FIG. 9.

The inverted T-shaped tap of FIGS. 9 and 10 is useful where heat and vibration are severe. The tap comprises a flat horizontal bar or member 30 with a narrower flat vertical stem of metal 31 projecting therefrom in the same plane midway between the ends of bar 30. Bar 30 is inserted between two adjoining flights of resistance element 15 in the same way as has been described hereinabove for tap 20, with stem 31 projecting therefrom. Bar 30 has turned-over projections 32 extending at right angles in opposite directions from its ends adjoining its edge nearer stem 31 so that when it is inserted between two flights, the projections act as stops preventing bar 30 from being pushed any further between the adjoining flights. The tap is thus automatically properly positioned by projections 32—32. Weld cap 22 may be used as described hereinabove to fix the tap in position. The length of weld cap 22 when so used is made equal or somewhat less than the distance between projections 32—32 on bar 30.

The frame side members 12, previously mentioned, are stiffened and braced to resist heat distortion by forming them with outwardly projecting V-shaped longitudinal corrugations 27 which extend over substantially the full length of the sides as shown in FIGS.

Figure 8:
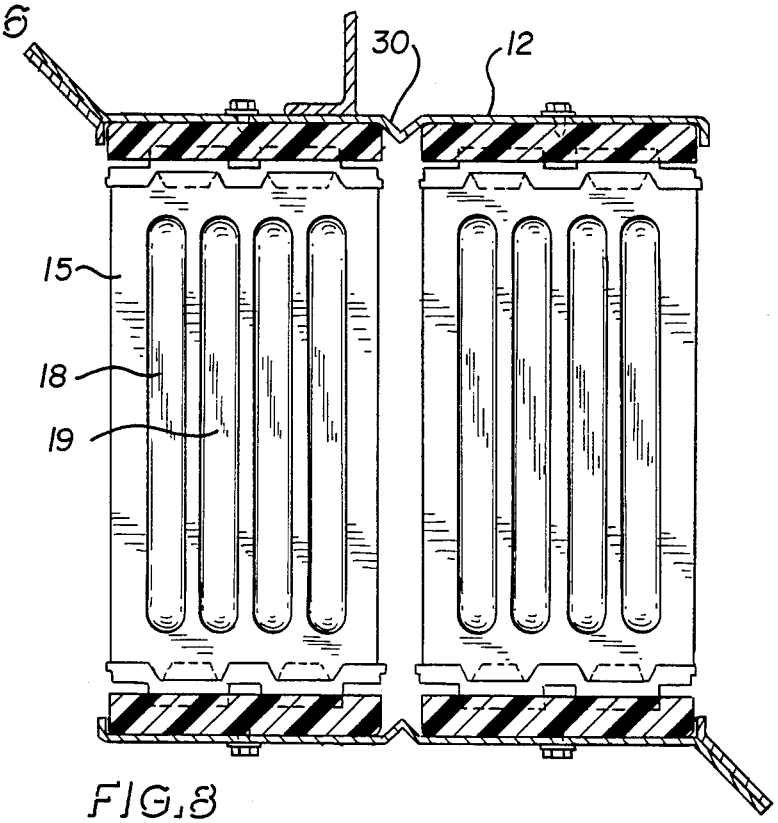
FIG. 8 is a detail of a modification of the resistor of FIG. 2.

1 and 2. Side members 12 are further stiffened by a bracing member 28 which spans corrugations 27 and are welded to member 12 outside of both corrugations. Members 28 also extend substantially the full length of side members 12. Those side members may be formed from two longitudinal members, one for each of the fan-folded resistor ribbons 15 as shown in FIG. 2, each member having an edge flange 29, which flanges 29 are welded or otherwise affixed together as is also shown in FIG. 2. Alternatively, as shown in FIG. 8, side members 12 may be made in one piece with an internally projecting V-shaped corrugation 30 extending longitudinally. The V-corrugation also serves to separate the two fan-folded resistor strips 15 and to position them on side members 12.

We claim:

1. In a resistor asssembly comprising an flat fan-folded strip having a plurality of indentations of resistance material connected at each end to an end terminal and disposed in parallel flights in a frame and supported at the ends of its folds the improvement comprising at least one terminal intermediate said end terminals, said intermediate terminal being dimensioned to be inserted into said assembly between adjoining flights, the depth of the indentations in said adjoining flights being dimensioned to make conducting contact with said intermediate terminal, and clip means adapted to be affixed to the edges of said adjoining flights and said intermediate terminal to hold said intermediate terminal in contact with said indentations in said adjoining flights, whereby the position of said intermediate terminal may be adjusted in an assembled resistor unit.

2. The resistor assembly of claim 1 in which the intermediate terminal is a flat metal strip having a thickness at least equal to the thickness of said resistance strip.

3. The resistor assembly of claim 2 in which said flat metal strip is T-shaped with a bar and a stem, said bar being adapted to fit between adjoining flights of resistance material and said stem being positioned to project from said flights.

4. The resistor assembly of claim 3 including projections normal to said bar at its ends so as to rest on said flights and position said intermediate terminal with its stem extending normal to said flights.

5. The resistor assembly of claim 1 in which said clip means comprise a channel with flanges which make electrical contact with said adjoining flights and a slot in its web through which said intermediate terminal projects.

6. The resistor assembly of claim 5 in which said slot is wider than the thickness of said intermediate terminal so as to permit weld metal to flow into said slot against said intermediate terminal and weld said intermediate terminal to said adjoining flights of said resistance strip.

7. The resistor assembly of claim 1 in which said frame supports two said flat fan-folded strips of resistance material mounted edge-to-edge between metal side elements, said side elements having at least one longitudinally extending indentation.

8. The resistor assembly of claim 7 in which said indentation projects inwardly from the plane of said side element.

9. The resistor assembly of claim 7 in which said two flat fan-folded strips are spaced from each other edgewise and including a longitudinally extending indentation between said two flat fan-folded strips.

10. The resistor assembly of claim 7 in which said longitudinally extending indentation projects internally between two fan-folded strips of resistance material.

11. The resistance unit of claim 5 including two said longitudinally extended indentations adjacent each fan-folded strip of resistance material, said indentations projecting outwardly and a longitudinally extending bracing member spanning said indentations and being affixed at its outer edges to said frame.

* * * * *

UNITED STATES PATENT AND TRADEMARK OFFICE

CERTIFICATE OF CORRECTION

PATENT NO. : 4,837,549

DATED : June 6, 1989

INVENTOR(S) : VICTOR KIRILLOFF, WILLIAM BENSON, ROBERT CUMMINS RICHARD DAWSON

It is certified that error appears in the above-identified patent and that said Letters Patent is hereby corrected as shown below:

Title Page

At [56] References Cited, insert

--4,100,526 7/1978 Kirilloff et al. 338/279
4,654,627 3/1987 Harkness 338/319
4,651,125 3/1987 Harkness 338/295--.

Column 1, line 28, change "ad" to --and--.

Column 1, line 32, change "Harness" to --Harkness--.

Column 1, line 56, change "invnetion" to --invention--.

Column 2, line 13, change "hld" to --hold--.

Signed and Sealed this

Second Day of February, 1993

*Attest:*

STEPHEN G. KUNIN

*Attesting Officer*

*Acting Commissioner of Patents and Trademarks*